US010332463B2

(12) United States Patent
Hao

(10) Patent No.: US 10,332,463 B2
(45) Date of Patent: Jun. 25, 2019

(54) DRIVING METHOD FOR LIQUID CRYSTAL DISPLAY PANEL AND DEVICE OF THE SAME

(71) Applicant: Shenzhen China Star Optoelectronics Semiconductor Display Technology Co., Ltd., Shenzhen, Guangdong (CN)

(72) Inventor: Sikun Hao, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/742,221

(22) PCT Filed: Dec. 13, 2017

(86) PCT No.: PCT/CN2017/115864
§ 371 (c)(1),
(2) Date: Jan. 5, 2018

(87) PCT Pub. No.: WO2018/209935
PCT Pub. Date: Nov. 22, 2018

(65) Prior Publication Data

US 2018/0374434 A1 Dec. 27, 2018

(30) Foreign Application Priority Data

May 16, 2017 (CN) ..... 2017 1 0344623

(51) Int. Cl.
*G09G 3/36* (2006.01)

(52) U.S. Cl.
CPC ..... *G09G 3/3607* (2013.01); *G09G 3/3614* (2013.01); *G09G 3/3696* (2013.01);
(Continued)

(58) Field of Classification Search
CPC .. G06F 1/3265; G09G 3/3607; G09G 3/3648; G09G 3/3688; G09G 2320/0626;
(Continued)

(56) References Cited

U.S. PATENT DOCUMENTS

2006/0022925 A1* 2/2006 Hara ..... G09G 3/3688 345/89
2006/0132418 A1* 6/2006 Morita ..... G09G 3/3614 345/98

(Continued)

FOREIGN PATENT DOCUMENTS

CN 101630493 A 1/2010
CN 105511174 A 4/2016

(Continued)

*Primary Examiner* — Shaheda A Abdin
(74) *Attorney, Agent, or Firm* — Ladas & Parry LLP

(57) ABSTRACT

The present disclosure provides a driving method and a driving device of a liquid crystal display panel, where the driving method includes applying a liquid crystal voltage on each pixel is obtained when a preset grayscale voltage is input. The liquid crystal voltage is a difference between a pixel voltage and a common voltage. A compensated grayscale voltage is obtained according to the liquid crystal voltage, and an initial grayscale voltage is transformed to a target grayscale voltage according to the compensated grayscale voltage, where the target grayscale voltage is input to the liquid crystal display panel.

20 Claims, 6 Drawing Sheets

(52) U.S. Cl.
CPC ..... *G09G 2320/0233* (2013.01); *G09G 2320/0247* (2013.01); *G09G 2320/0633* (2013.01)

(58) Field of Classification Search
CPC ..... G09G 2320/0673; G09G 2380/08; G09G 2310/0291; H05B 33/0803
See application file for complete search history.

(56) References Cited

U.S. PATENT DOCUMENTS

2007/0229431 A1* 10/2007 Kang ..... G09G 3/3614 345/96
2007/0291190 A1* 12/2007 Shin ..... G09G 3/3696 349/37

FOREIGN PATENT DOCUMENTS

CN 105529011 A 4/2016
KR 20150039468 A 4/2015

* cited by examiner

| Initial grayscale voltage | | |
|---|---|---|
| S11 | S12 | S13 |
| S21 | S22 | S23 |
| S31 | S32 | S33 |

| Look-up table | | |
|---|---|---|
| S11→H11(+)<br>S11→L11(-) | S12→H21(+)<br>S12→L21(-) | S13→H13(+)<br>S13→L13(-) |
| S21→H21(+)<br>S21→L21(-) | S22→H22(+)<br>S22→L22(-) | S23→H23(+)<br>S23→L23(-) |
| S31→H31(+)<br>S31→L31(-) | S32→H32(+)<br>S32→L32(-) | S33→H33(+)<br>S33→L33(-) |

| Outputs of the source driver | | |
|---|---|---|
| H11(+)<br>L11(-) | H21(+)<br>L21(-) | H13(+)<br>L13(-) |
| H21(+)<br>L21(-) | H22(+)<br>L22(-) | H23(+)<br>L23(-) |
| H31(+)<br>L31(-) | H32(+)<br>L32(-) | H33(+)<br>L33(-) |

DRIVING METHOD FOR LIQUID CRYSTAL DISPLAY PANEL AND DEVICE OF THE SAME

BACKGROUND OF THE INVENTION

Field of Invention

The present disclosure relates to the field of liquid crystal display (LCD) technology, and particularly to a driving method for an LCD panel and a device of the same.

Description of Prior Art

Because of the visual staying phenomenon, images on an LCD panel easily flash. The visual staying phenomenon means that human eyes still retain images after the images disappear. Basically, human eyes will refresh at a frequency of about 16-24 Hz; however, because human eyes are sensitive to lightness/darkness, so in fact, even in a 30 Hz refresh rate, human eyes can still detect screen brightness difference (flashing). Hence, if a better image quality is desired, a higher frequency refresh rate is needed.

Because liquid crystals deteriorate over residual direct-current (DC), and other issues when the liquid crystals are driven by long-term DC, generally, the LCD display panels are driven by AC. When the LCD is driven by the same grayscale AC, positive and negative half-cycle input signals will be affected by electricity and other related effects, resulting in the LCD voltages in different positive and negative half cycles.

As shown in FIG. 1, V0 represents a common voltage, V1 and V2 represent different amplitudes of grayscale voltage of the positive polarity, and V1 is greater than V2. V3 and V4 represent different amplitudes of grayscale voltage of the negative polarity, V3 is greater than V4. 11-19 represent pixel voltages of the pixels at different positions of the liquid crystal display (LCD) panel, when driven by the positive polarity/the negative polarity. When combined with FIG. 2, 11-13 respectively correspond to the first column of pixels in FIG. 2, 14-16 respectively correspond to the second column of pixels in FIG. 2, and 17-19 respectively correspond to the third column of pixels in FIG. 2. It can be seen that when the positive polarity driving voltage is applied, the liquid crystal voltages of the pixels on both sides of the panel are relatively small and the liquid crystal voltages of the intermediate pixel are relatively large. When the negative polarity driving voltage is applied, the liquid crystal voltages of the pixels on both sides of the panel are relatively large and the liquid crystal voltages of the intermediate pixel are relatively small. As shown in FIGS. 2 and 3, since the liquid crystal voltages of the positive and negative half cycles are different, the brightness of the images when the LCD is driven by the positive polarity voltage are different from that driven by the negative polarity voltage, the deep gray color represents the low brightness and the light gray represents the high brightness, resulting in screen flicker.

Therefore, it is necessary to provide a driving method and a driving device for an LCD panel to solve the problems existing in the conventional art.

SUMMARY OF THE INVENTION

The objective of the present disclosure is to provide a driving method and a driving device of a liquid crystal display (LCD) panel, to improve the display effect.

In order to solve the above technical problem, the present disclosure provides a driving method for an LCD panel, which comprises:

A liquid crystal voltage applied to each pixel is obtained when a preset grayscale voltage is input. The liquid crystal voltage is a difference between a pixel voltage and a common voltage.

A compensated grayscale voltage is obtained according to the liquid crystal voltage and a preset voltage.

An initial grayscale voltage is transformed to a target grayscale voltage according to the compensated grayscale voltage.

The target grayscale voltage is input to an LCD panel, to make the LCD panel keep the brightness of images the same during a display process.

Wherein an initial brightness of the LCD panel and a compensated brightness of the LCD panel are matched, the initial brightness is a brightness when the LCD panel is input with the initial grayscale voltage, and the compensated brightness is a brightness when the LCD panel is input with the compensated grayscale voltage.

In the driving method for an LCD panel according to the present disclosure, the initial grayscale voltage comprises a positive polarity initial grayscale voltage and a negative polarity initial grayscale voltage.

The step of obtaining a compensated grayscale voltage according to the liquid crystal voltage comprises:

A positive grayscale voltage and a negative grayscale voltage are obtained according to the liquid crystal voltage.

The step of transforming an initial grayscale voltage to a target grayscale voltage according to the compensated grayscale voltage comprises:

A positive polarity initial grayscale voltage is transformed to a first target grayscale voltage according to the positive compensated grayscale voltage.

A negative polarity initial grayscale voltage is transformed to a second target grayscale voltage according to the negative compensated grayscale voltage.

In the driving method for an LCD panel according to the present disclosure, the first target grayscale voltage is used to keep the brightness of images the same, when the LCD panel is driven by positive voltages.

The second target grayscale voltage is used to keep the brightness of images the same, when the LCD panel is driven by negative voltages.

In the driving method for an LCD panel according to the present disclosure, when the initial brightness is lower than a preset brightness, the compensated brightness is higher than the preset brightness.

In the driving method for an LCD panel according to the present disclosure, when the initial brightness is higher than or equal to a preset brightness, the compensated brightness is lower than or equal to the preset brightness.

In the driving method for an LCD panel according to the present disclosure, the compensated gray-value voltage is proportional to the compensated brightness.

In order to solve the above technical problem, the present disclosure provides a driving method for an LCD panel, which comprises:

A liquid crystal voltage applied to each pixel is obtained when a preset grayscale voltage is input. The liquid crystal voltage is a difference between a pixel voltage and a common voltage.

A compensated grayscale voltage is obtained according to the liquid crystal voltage.

An initial grayscale voltage is transformed to a target grayscale voltage according to the compensated grayscale voltage.

The target grayscale voltage is input to an LCD panel, to make the LCD panel keep the brightness of images the same during a display process.

In the driving method for an LCD panel according to the present disclosure, the step of obtaining a compensated grayscale voltage according to the liquid crystal voltage comprises:

The compensated grayscale voltage is obtained according to the liquid crystal voltage and a preset voltage.

In the driving method for an LCD panel according to the present disclosure, the initial grayscale voltage comprises a positive polarity initial grayscale voltage and a negative polarity initial grayscale voltage.

The step of obtaining a compensated grayscale voltage according to the liquid crystal voltage comprises:

A positive grayscale voltage and a negative grayscale voltage are obtained according to the liquid crystal voltage.

The step of transforming an initial grayscale voltage to a target grayscale voltage according to the compensated grayscale voltage comprises:

A positive polarity initial grayscale voltage is transformed to a first target grayscale voltage according to the positive compensated grayscale voltage.

A negative polarity initial grayscale voltage is transformed to a second target grayscale voltage according to the negative compensated grayscale voltage.

In the driving method for an LCD panel according to the present disclosure, the first target grayscale voltage is used to keep the brightness of images the same, when the LCD panel is driven by positive voltages.

The second target grayscale voltage is used to keep the brightness of images the same, when the LCD panel is driven by negative voltages.

In the driving method for an LCD panel according to the present disclosure, an initial brightness of the LCD panel and a compensated brightness of the LCD panel are matched, the initial brightness is a brightness when the LCD panel is input with the initial grayscale voltage, and the compensated brightness is a brightness when the LCD panel is input with the compensated grayscale voltage.

In the driving method for an LCD panel according to the present disclosure, when the initial brightness is lower than a preset brightness, the compensated brightness is higher than the preset brightness.

In the driving method for an LCD panel according to the present disclosure, when the initial brightness is higher than or equal to a preset brightness, the compensated brightness is lower than or equal to the preset brightness.

In the driving method for an LCD panel according to the present disclosure, the compensated gray-value voltage is proportional to the compensated brightness.

The present disclosure further provides a driving device for an LCD panel, which comprises:

A first obtaining unit is configured to obtain a liquid crystal voltage applied to each pixel, when a preset grayscale voltage is input. The liquid crystal voltage is a difference between a pixel voltage and a common voltage.

A second obtaining unit is configured to obtain a compensated grayscale voltage according to the liquid crystal voltage.

A transforming unit is configured to transform an initial grayscale voltage to a target grayscale voltage according to the compensated grayscale voltage.

A display unit is configured to input the target grayscale voltage to an LCD panel, to make the LCD panel keep the brightness of images the same during a display process.

In the driving device for an LCD panel according to the present disclosure, the second obtaining unit is specifically used for obtaining the compensated grayscale voltage according to the liquid crystal voltage and a preset voltage.

In the driving device for an LCD panel according to the present disclosure, the initial grayscale voltage comprises a positive polarity initial grayscale voltage and a negative polarity initial grayscale voltage.

The second obtaining unit is further used for obtaining a positive grayscale voltage and a negative grayscale voltage according to the liquid crystal voltage.

The transforming unit is specifically used for transforming a positive polarity initial grayscale voltage to a first target grayscale voltage according to the positive compensated grayscale voltage; and transforming a negative polarity initial grayscale voltage to a second target grayscale voltage according to the negative compensated grayscale voltage.

In the driving device for an LCD panel according to the present disclosure, the first target grayscale voltage is used to keep the brightness of images the same, when the LCD panel is driven by positive voltages.

The second target grayscale voltage is used to keep the brightness of images the same, when the LCD panel is driven by negative voltages.

In the driving device for an LCD panel according to the present disclosure, an initial brightness of the LCD panel and a compensated brightness of the LCD panel are matched, the initial brightness is a brightness when the LCD panel is input with the initial grayscale voltage, and the compensated brightness is a brightness when the LCD panel is input with the compensated grayscale voltage.

In the driving device for an LCD panel according to the present disclosure, when the initial brightness is lower than a preset brightness, the compensated brightness is higher than the preset brightness; when the initial brightness is higher than or equal to a preset brightness, the compensated brightness is lower than or equal to the preset brightness.

The driving method and the driving device for driving an LCD panel according to the present disclosure obtain a liquid crystal voltage applied to each pixel is obtained when a preset grayscale voltage is input; then, a compensated grayscale voltage is obtained according to the liquid crystal voltage and a preset voltage; then, an initial grayscale voltage is transformed to a target grayscale voltage according to the compensated grayscale voltage; then, the target grayscale voltage is input to an LCD panel, to make the LCD panel keep the brightness of images the same during a display process, thereby preventing flickering of the LCD panel and improving the display effect.

DETAILED DESCRIPTION OF THE PREFERRED EMBODIMENTS

Figure 1:
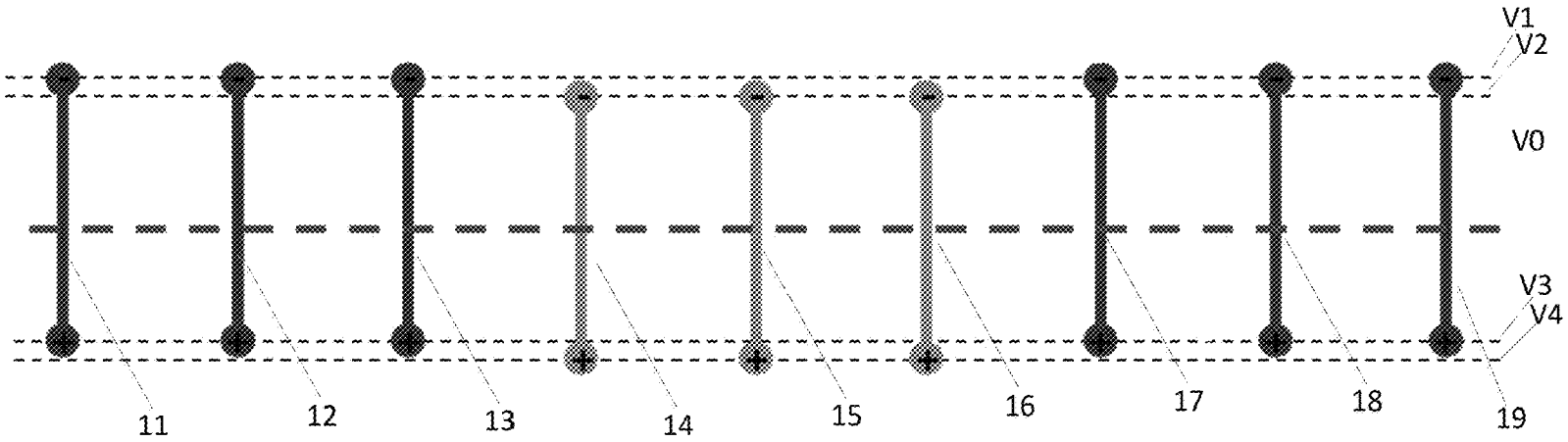
FIG. 1 is a diagram of the liquid crystal voltages of pixels at different positions for a conventional LCD panel driven by positive/negative-polarity voltages.
Figure 2:
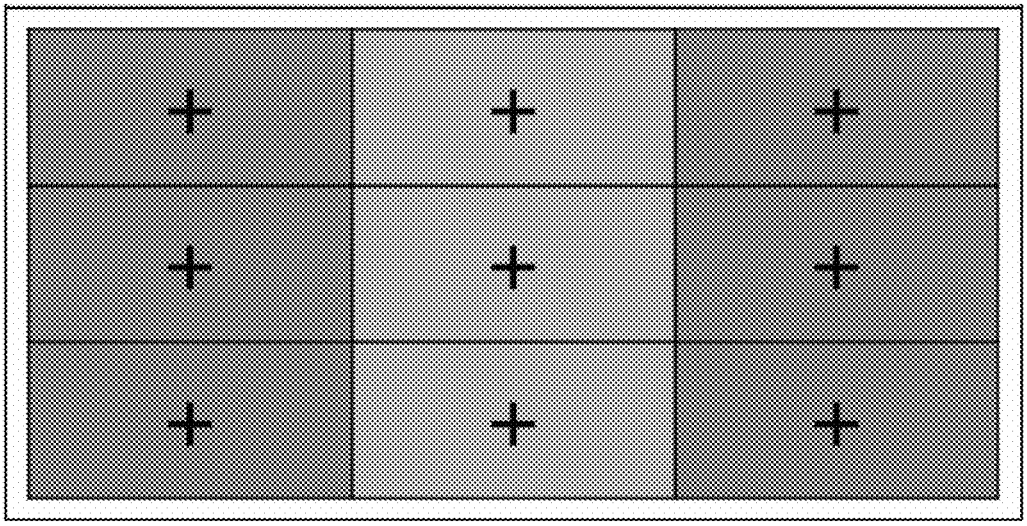
FIG. 2 is a brightness diagram of display images for a conventional LCD panel driven by positive-polarity voltage.
Figure 3:
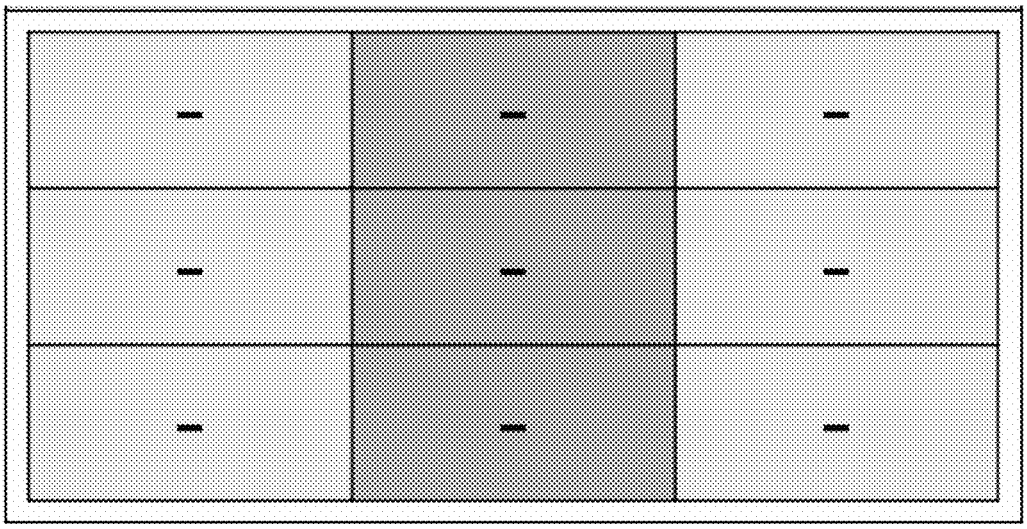
FIG. 3 is a brightness diagram of display images of a conventional LCD panel driven by negative-polarity voltage.

The following description of the embodiments is directed to the attached drawings for illustrating specific embodiments in which the disclosure may be practiced. The terms of the present disclosure, such as "up", "down", "front", "post", "left", "right", "inside", "outside", "side", are merely directions referring to attached drawings. Thus, the directional language used is for the purpose of illustrating and understanding the invention and is not intended to be limiting of the invention. In the figure, units with similar structures are denoted by the same reference numerals.

Please refer to FIGS. 4-7, which are diagrams of the liquid crystal voltages of pixels at different positions according to the liquid crystal display (LCD) panel of the present disclosure driven by positive/negative-polarity voltages.

The driving method for an LCD panel according to the present disclosure comprises:

S101, a liquid crystal voltage applied to each pixel is obtained when a preset grayscale voltage is input.

For example, the preset grayscale voltage is input to the LCD panel to obtain the pixel voltage applied to each pixel and the difference between the pixel voltage and the common voltage. That is, the liquid crystal voltage is a difference between the pixel voltage and the common voltage.

S102, a compensated grayscale voltage is obtained according to the liquid crystal voltage.

For example, the compensated grayscale voltage is obtained according to the liquid crystal voltage of each pixel acquired by the step S101, which is used to compensate the brightness of the pixel. In order to improve the compensation efficiency, the compensated grayscale voltage can be stored.

In order to improve the compensation effect, specifically, the step S102 can comprise:

S1021, the compensated grayscale voltage is obtained according to the liquid crystal voltage and the preset voltage.

For example, the preset voltage is a corresponding liquid crystal voltage value when the display brightness of the panel is consistent or equal. That is, the compensated grayscale voltage of each pixel is obtained when the realistic liquid crystal voltage is the same as the liquid crystal voltage while the display brightness is consistent. In one embodiment, a difference between the realistic liquid crystal voltage of each pixel and the liquid crystal voltage while the display brightness is consistent is obtained, and the compensated grayscale voltage of each pixel is obtained according to the difference.

The compensated grayscale voltage comprises a positive compensated grayscale voltage and a negative compensated grayscale voltage.

S103, an initial grayscale voltage is transformed to a target grayscale voltage according to the compensated grayscale voltage.

For example, the initial grayscale voltage is the grayscale voltage supplied to the LCD panel externally, and the grayscale voltage supplied to outside is transformed according to the grayscale voltage of each pixel to obtain the target grayscale voltage.

The initial grayscale voltage includes a positive polarity initial grayscale voltage and a negative polarity initial grayscale voltage.

S104, the target grayscale voltage is input to an LCD panel, to make the LCD panel keep the brightness of images the same during a display process.

For example, a transformed grayscale voltage is input to the LCD panel, so that the brightness of the image of the LCD panel remains consistent or equal during the display process, that is, there is no brightness difference.

The embodiment also provides a preferred driving method, comprising:

S201, a liquid crystal voltage applied to each pixel is obtained when a preset grayscale voltage is input.

For example, the preset grayscale voltage may include a positive polarity preset grayscale voltage and a negative polarity grayscale voltage. For example, when the positive polarity preset grayscale voltage is input to the LCD panel, the pixel voltage of each pixel is obtained, and a difference between the pixel voltage and the common voltage is calculated, to obtain a positive polarity liquid crystal voltage. When the negative polarity preset grayscale voltage is input to the LCD panel, the pixel voltage of each pixel is obtained, and a difference between the pixel voltage and the common voltage is calculated, to obtain a negative polarity liquid crystal voltage.

S202, a positive polarity compensated grayscale voltage and a negative polarity compensated voltage are obtained according to the liquid crystal voltage.

For example, the positive polarity compensated grayscale voltage of each pixel is obtained with the positive polarity liquid crystal voltage obtained by the step S201, and the negative polarity compensated grayscale voltage of each pixel is obtained with the negative polarity liquid crystal voltage obtained by the step S201. In order to improve the efficiency of compensation, the positive polarity and negative polarity compensated grayscale voltage can be stored.

S203, a positive polarity initial grayscale voltage is transformed to a first target grayscale voltage according to the positive compensated grayscale voltage and a negative polarity initial grayscale voltage is transformed to a second target grayscale voltage according to the negative compensated grayscale voltage.

The first target grayscale voltage is used to keep the brightness of the image consistently, when the LCD panel is driven by the positive polarity voltage. The second target grayscale voltage is used to keep the brightness of the image consistent, when the LCD panel is driven by the negative polarity voltage.

Figure 8:
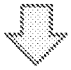
FIG. 8 is a Table showing that positive polarity grayscale voltages are converted to grayscale voltages.
Figure 8:
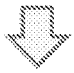

In the specific conversion process, reference can be made to the table of FIG. 8: as shown in FIG. 8, S11-S33 are the initial grayscale voltage inputted externally, 11-33 are the numbers, the different numbers corresponding to the different positions of the LCD panel.

First, with reference to the table of FIG. 8, when outputting the positive polarity grayscale voltage, S11-S33 are converted to grayscale voltages H11-H33, that is, positive polarity target grayscale voltages. When outputting the negative polarity grayscale voltage, S11-S33 are converted into grayscale voltages L11-L33, that is, the negative polarity target grayscale voltages.

First, with reference to the table, when outputting the positive polarity grayscale voltage, S11-S33 are converted to grayscale voltages H11-H33, that is, positive polarity target grayscale voltages. When outputting the negative polarity grayscale voltage, S11-S33 are converted into grayscale voltages L11-L33, that is, the negative polarity target grayscale voltages.

S204, the first target grayscale voltage and the second target grayscale voltage are inputted to the LCD panel to keep the brightness of the image consistent during the display process.

As the different regions of the panel correspond to different positive and negative polarity grayscale voltages, so that the flicking of the panel is adjusted by the positive and negative polarity grayscale voltages of different regions.

After the look-up table of FIG. 8, the driving signals of different regions of the LCD display panel and the grayscale voltages form a one-by-one relationship, and are then outputted to the LCD panel by the source driver chip (Source Driver). As shown in FIG. 8, the grayscale voltages H11-H33 are outputted at the positive polarity, and the grayscale voltages L11-L33 are outputted at the negative polarity.

Figure 4:
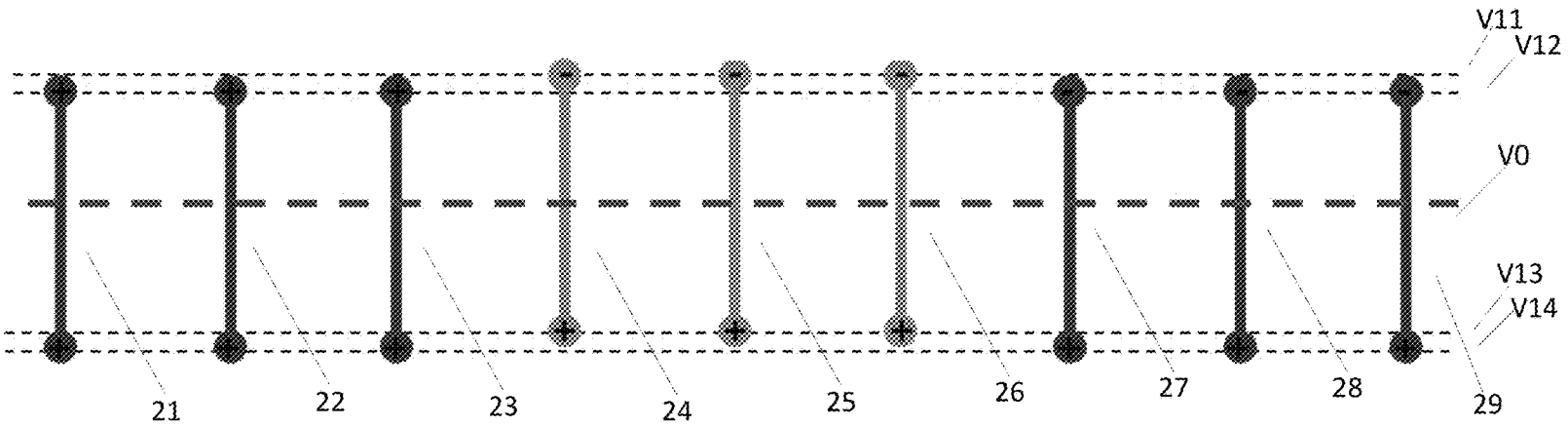
FIG. 4 is a diagram of the liquid crystal voltages of pixels at different positions for the LCD panel according to the present disclosure, driven by positive/negative-polarity compensated grayscale voltages.

Specifically, the principle of the driving method according to the present application is:

As shown in FIG. 4, V0 represents the common voltage, V11 and V12 represent the different amplitudes of grayscale voltage of the positive polarity, and V11 is greater than V12. V13, and V14 represent different amplitudes of grayscale voltage of the negative polarity, V13 is greater than V14. 21-29 represent the pixel voltages of the pixels at different positions of the LCD panel, when driven by the positive polarity/the negative polarity. For example, the panel includes three rows and three columns of pixels, that is, the structure of the panel is the same as that of FIG. 6. 21-23 respectively correspond to the first column of pixels, 24-26 respectively correspond to the second column of pixels, and 27-29 respectively correspond to the third column of pixels. It can be seen that when the positive polarity compensated grayscale voltage is applied, the liquid crystal voltages of the pixels on both sides of the panel are relatively large and the liquid crystal voltages of the intermediate pixels are relatively small. When the negative polarity compensated grayscale voltage is applied, the liquid crystal voltages of the pixels on both sides of the panel are relatively small and the liquid crystal voltages of the intermediate pixel are relatively large. The liquid crystal voltage is the difference between the pixel voltage and the common voltage.

That is, the positive and the negative half-cycle grayscale voltages of different regions of the LCD in FIG. 4 are different from the positive and the negative grayscale voltages corresponding to the different regions in FIG. 1.

When driven with the positive polarity, in FIG. 1, the pixel voltages of the left and right sides of the display image are relatively low and the brightness is relatively dark, the pixel voltages of the middle of the display image are relatively high and the brightness is relatively bright. In FIG. 4, the pixel voltages of the left and right sides of the display image are relatively high and the brightness is relatively high, the pixel voltages of the middle of the display image are relatively low and the brightness is relatively dark. The compensated grayscale voltages are proportional to the compensated brightness, that is, the greater the compensated grayscale voltage, the higher the compensated brightness.

When driven with the negative polarity, in FIG. 1, the pixel voltages of the left and right sides of the display image are relatively high and the brightness is relatively bright, the pixel voltages of the middle of the display image are relatively low and the brightness is relatively dark. In FIG. 4, the pixel voltages of the left and right sides of the display image are relatively low and the brightness is relatively dark, the pixel voltages of the middle of the display image are relatively high and the brightness is relatively bright.

That is, the initial brightness of the LCD panel is matched (or complementary) to the compensated brightness of the LCD panel, and the initial brightness is a brightness when the initial grayscale voltage is input to the LCD panel, and the compensated brightness is a brightness when the compensated grayscale voltage is input to the LCD panel.

The compensated brightness is greater than a preset brightness when the initial brightness is less than the preset brightness. The compensated brightness is less than or equal to a preset brightness when the initial brightness is greater than or equal to the preset brightness.

Figure 5:
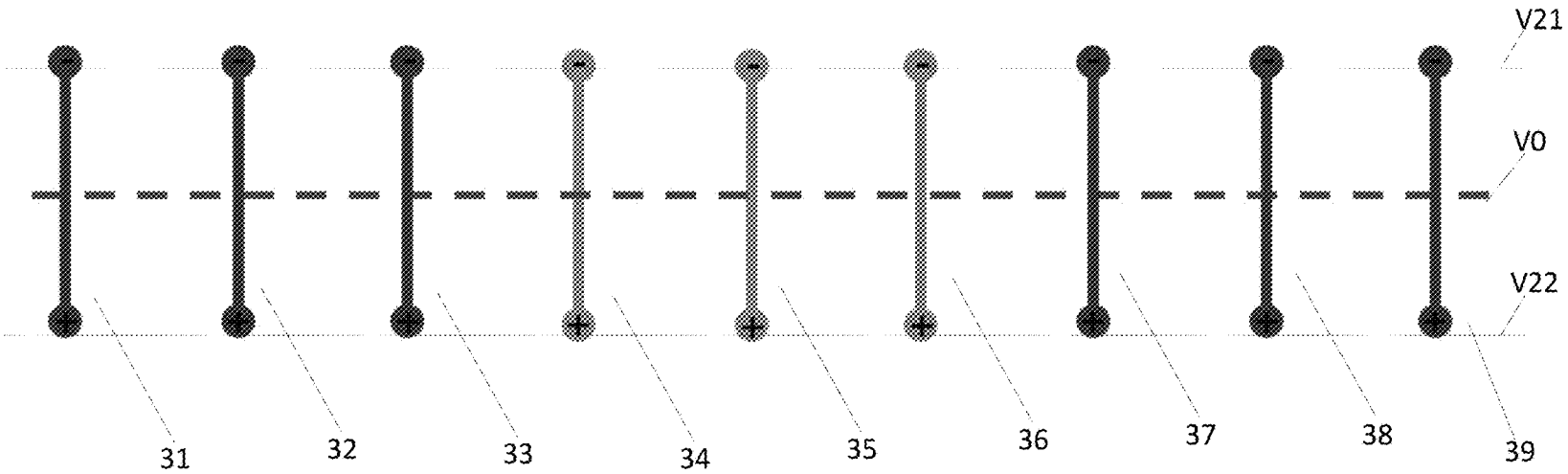
FIG. 5 is a diagram of the liquid crystal voltages of pixels at different positions for the LCD panel according to the present disclosure, driven by positive/negative-polarity target grayscale voltages.

As shown in FIG. 5, V0 represents the common voltage, V21 represents the positive polarity grayscale voltage, V22 represents the negative polarity grayscale voltage, and 31-39 represent the pixel voltages of the pixels at different positions of the LCD panel, when driven by the positive polarity/the negative polarity. With combined with FIG. 6, 31-33 respectively correspond to the first column of pixels in FIG. 6, 34-36 respectively correspond to the second column of pixels in FIG. 6, and 37-39 respectively correspond to the third column of pixels in FIG. 6. It can be seen that when the positive polarity compensated grayscale voltage is applied, the liquid crystal voltages of the pixels on both sides of the panel are equal to the liquid crystal voltage of the intermediate pixel. When the negative polarity compensated grayscale voltage is applied, the liquid crystal voltages of the pixels on both sides of the panel are equal to the liquid crystal voltages of the intermediate pixels.

Figure 6:
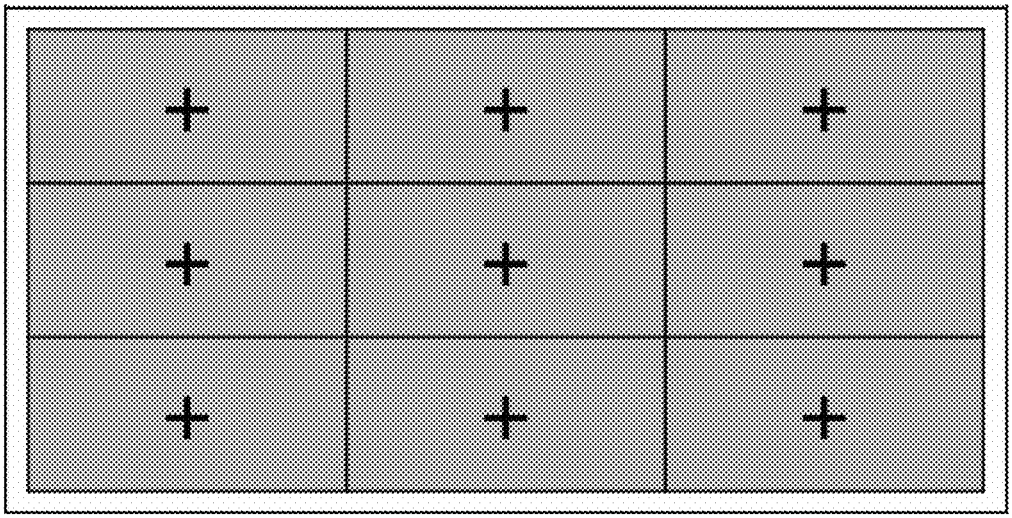
FIG. 6 is a brightness diagram of display images for the LCD panel according to the present disclosure, driven by positive-polarity target grayscale voltage.
Figure 7:
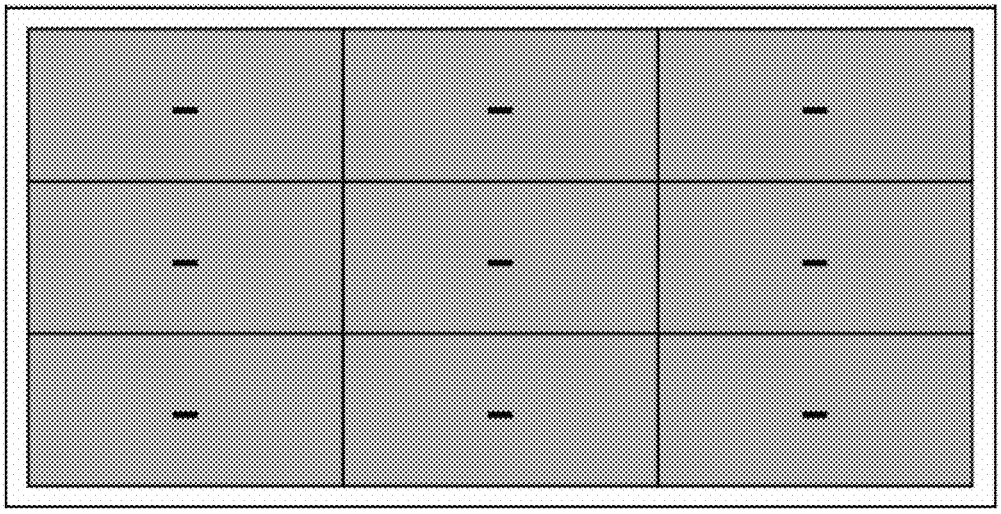
FIG. 7 is a brightness diagram of display images for the LCD panel according to the present disclosure, driven by negative-polarity target grayscale voltage.

With the driving method for an LCD according to the present disclosure, the liquid crystal voltages of pixels at different positions are the same, when driven by the positive/negative polarity, so that the liquid crystal voltage of the pixels at different positions of the LCD are consistent. Thus the brightness of the display images are the same, when the LCD is driven by the positive polarity/negative polarity voltages, as shown in FIGS. 6-7. As the brightness of the display images are the same, when the LCD is driven by the positive polarity/negative polarity voltages, the flicking within the LCD is avoided and the display effect is improved.

The embodiment of the present disclosure further provides a driving device for an LCD panel, which comprises a first obtaining unit, a second obtaining unit, a transforming unit and a display unit.

The first obtaining unit is configured to obtain a liquid crystal voltage applied to each pixel, when a preset grayscale voltage is input. The liquid crystal voltage is a difference between a pixel voltage and a common voltage.

The second obtaining unit, configured to obtain a compensated grayscale voltage according to the liquid crystal voltage.

The transforming unit, configured to transform an initial grayscale voltage to a target grayscale voltage according to the compensated grayscale voltage.

The display unit, configured to input the target grayscale voltage to an LCD panel, to make the LCD panel keep the brightness of images the same during a display process.

The second obtaining unit is specifically used for obtaining the compensated grayscale voltage according to the liquid crystal voltage and a preset voltage.

The initial grayscale voltage comprises a positive polarity initial grayscale voltage and a negative polarity initial grayscale voltage. The second obtaining unit is further used for obtaining a positive grayscale voltage and a negative grayscale voltage according to the liquid crystal voltage.

The transforming unit is specifically used for transforming a positive polarity initial grayscale voltage to a first target grayscale voltage according to the positive compensated grayscale voltage; and transforming a negative polarity initial grayscale voltage to a second target grayscale voltage according to the negative compensated grayscale voltage.

The first target grayscale voltage is used to keep the brightness of images the same, when the LCD panel is driven by positive voltages. The second target grayscale voltage is used to keep the brightness of images the same, when the LCD panel is driven by negative voltages.

An initial brightness of the LCD panel and a compensated brightness of the LCD panel are matched, the initial brightness is the brightness when the LCD panel is input with the initial grayscale voltage, and the compensated brightness is the brightness when the LCD panel is input with the compensated grayscale voltage.

When the initial brightness is lower than a preset brightness, the compensated brightness is higher than the preset brightness; when the initial brightness is higher than or equal to a preset brightness, the compensated brightness is lower than or equal to the preset brightness.

The compensated grayscale voltage is proportional to the compensated brightness.

The driving method and the driving device for driving an LCD panel according to the present disclosure obtain a liquid crystal voltage applied to each pixel which is obtained when a preset grayscale voltage is input; then, a compensated grayscale voltage is obtained according to the liquid crystal voltage and a preset voltage; then, an initial grayscale voltage is transformed to a target grayscale voltage according to the compensated grayscale voltage; then, the target grayscale voltage is input to an LCD panel, to make the LCD panel keep the brightness of images the same during a display process, thereby preventing flickering of the LCD panel and improving the display effect.

In the present disclosure, the LCD device keeps the voltage of the sub-pixel portion constant during alignment process with adding additional common lines, to avoid the influences on the internal resistance of the third thin film transistor T3 and the resistance of the deep-shallow hole caused by the manufacturing process, hence, the voltage unevenness of the sub-pixel portion is avoided to make the alignment more even, and the display effect is raised accordingly.

Although the present disclosure is disclosed as preferred embodiments, the foregoing preferred embodiments are not intended to limit the present disclosure. Those of ordinary skill in the art, without departing from the spirit and scope of the present disclosure, can make various kinds of modifications and variations to the present disclosure. Therefore, the scope of the claims of the present disclosure must be defined.

What is claimed is:

1. A driving method for a liquid crystal display panel, comprising:

obtaining a liquid crystal voltage applied to each pixel when a preset grayscale voltage is input, the liquid crystal voltage being a difference between a pixel voltage and a common voltage;

obtaining a compensated grayscale voltage according to the liquid crystal voltage and a preset voltage;

transforming an initial grayscale voltage into a target grayscale voltage according to the compensated grayscale voltage; and inputting the target grayscale voltage to the liquid crystal display panel, to make the liquid crystal display panel keep a same brightness of images during a display process;

wherein an initial brightness of the liquid crystal display panel matches and a compensated brightness of the liquid crystal display panel, the initial brightness is a brightness when the liquid crystal display panel is input with the initial grayscale voltage, and the compensated brightness is a brightness when the liquid crystal display panel is input with the compensated grayscale voltage.

2. The driving method for liquid crystal display panel according to claim 1, wherein the initial grayscale voltage comprises a positive polarity initial grayscale voltage and a negative polarity initial grayscale voltage;

the step of obtaining a compensated grayscale voltage according to the liquid crystal voltage comprises:

obtaining a positive grayscale voltage and a negative grayscale voltage according to the liquid crystal voltage;

the step of transforming an initial grayscale voltage to a target grayscale voltage according to the compensated grayscale voltage comprises:

transforming a positive polarity initial grayscale voltage to a first target grayscale voltage according to the positive compensated grayscale voltage;

transforming a negative polarity initial grayscale voltage to a second target grayscale voltage according to the negative compensated grayscale voltage.

3. The driving method for liquid crystal display panel according to claim 2, wherein the first target grayscale voltage is used to keep the brightness of images the same, when the liquid crystal display panel is driven by positive voltages;

the second target grayscale voltage is used to keep the brightness of images the same, when the liquid crystal display panel is driven by negative voltages.

4. The driving method for liquid crystal display panel according to claim 1, wherein when the initial brightness is lower than a preset brightness, the compensated brightness is higher than the preset brightness.

5. The driving method for liquid crystal display panel according to claim 1, wherein when the initial brightness is higher than or equal to a preset brightness, the compensated brightness is lower than or equal to the preset brightness.

6. The driving method for liquid crystal display panel according to claim 1, wherein the compensated gray-value voltage is proportional to the compensated brightness.

7. A driving method for a liquid crystal display panel, comprising:

obtaining a liquid crystal voltage applied to each pixel when a preset grayscale voltage is input, the liquid crystal voltage being a difference between a pixel voltage and a common voltage;

obtaining a compensated grayscale voltage according to the liquid crystal voltage;

transforming an initial grayscale voltage into a target grayscale voltage according to the compensated grayscale voltage; and inputting the target grayscale voltage to the liquid crystal display panel, to make the liquid crystal display panel keep a same brightness of images during a display process.

8. The driving method for liquid crystal display panel according to claim 7, wherein the step of obtaining a compensated grayscale voltage according to the liquid crystal voltage comprises:

obtaining the compensated grayscale voltage according to the liquid crystal voltage and a preset voltage.

9. The driving method for liquid crystal display panel according to claim 7, wherein the initial grayscale voltage comprises a positive polarity initial grayscale voltage and a negative polarity initial grayscale voltage;

the step of obtaining a compensated grayscale voltage according to the liquid crystal voltage comprises:

obtaining a positive grayscale voltage and a negative grayscale voltage according to the liquid crystal voltage;

the step of transforming an initial grayscale voltage to a target grayscale voltage according to the compensated grayscale voltage comprises:

transforming a positive polarity initial grayscale voltage to a first target grayscale voltage according to the positive compensated grayscale voltage;

transforming a negative polarity initial grayscale voltage to a second target grayscale voltage according to the negative compensated grayscale voltage.

10. The driving method for liquid crystal display panel according to claim 9, wherein the first target grayscale voltage is used to keep the brightness of images the same, when the liquid crystal display panel is driven by positive voltages;

the second target grayscale voltage is used to keep the brightness of images the same, when the liquid crystal display panel is driven by negative voltages.

11. The driving method for liquid crystal display panel according to claim 7, wherein an initial brightness of the liquid crystal display panel and a compensated brightness of the liquid crystal display panel are matched, the initial brightness is a brightness when the liquid crystal display panel is input with the initial grayscale voltage, and the compensated brightness is a brightness when the liquid crystal display panel is input with the compensated grayscale voltage.

12. The driving method for liquid crystal display panel according to claim 11, wherein when the initial brightness is lower than a preset brightness, the compensated brightness is higher than the preset brightness.

13. The driving method for liquid crystal display panel according to claim 11, wherein when the initial brightness is higher than or equal to a preset brightness, the compensated brightness is lower than or equal to the preset brightness.

14. The driving method for liquid crystal display panel according to claim 11, wherein the compensated gray-value voltage is proportional to the compensated brightness.

15. A driving device for a liquid crystal display panel, comprising:

a first obtaining unit configured to obtain a liquid crystal voltage applied to each pixel, when a preset grayscale voltage is input, the liquid crystal voltage being a difference between a pixel voltage and a common voltage;

a second obtaining unit configured to obtain a compensated grayscale voltage according to the liquid crystal voltage;

a transforming unit configured to transform an initial grayscale voltage into a target grayscale voltage according to the compensated grayscale voltage; and a display unit, configured to input the target grayscale voltage to the liquid crystal display panel, to make the liquid crystal display panel keep a same brightness of images during a display process.

16. The driving device for liquid crystal display panel according to claim 15, wherein the second obtaining unit is specifically used for obtaining the compensated grayscale voltage according to the liquid crystal voltage and a preset voltage.

17. The driving device for liquid crystal display panel according to claim 15, wherein the initial grayscale voltage comprises a positive polarity initial grayscale voltage and a negative polarity initial grayscale voltage;

the second obtaining unit is further used for obtaining a positive grayscale voltage and a negative grayscale voltage according to the liquid crystal voltage;

the transforming unit is specifically used for transforming a positive polarity initial grayscale voltage to a first target grayscale voltage according to the positive compensated grayscale voltage; and transforming a negative polarity initial grayscale voltage to a second target grayscale voltage according to the negative compensated grayscale voltage.

18. The driving device for liquid crystal display panel according to claim 17, wherein the first target grayscale voltage is used to keep the brightness of images the same, when the liquid crystal display panel is driven by positive voltages;

the second target grayscale voltage is used to keep the brightness of images the same, when the liquid crystal display panel is driven by negative voltages.

19. The driving device for liquid crystal display panel according to claim 15, wherein an initial brightness of the liquid crystal display panel and a compensated brightness of the liquid crystal display panel are matched, the initial brightness is a brightness when the liquid crystal display panel is input with the initial grayscale voltage, and the compensated brightness is a brightness when the liquid crystal display panel is input with the compensated grayscale voltage.

20. The driving device for liquid crystal display panel according to claim 19, wherein when the initial brightness is lower than a preset brightness, the compensated brightness is higher than the preset brightness; when the initial brightness is higher than or equal to a preset brightness, the compensated brightness is lower than or equal to the preset brightness.

* * * * *